US007661905B2

(12) United States Patent
Alhayari

(10) Patent No.: US 7,661,905 B2
(45) Date of Patent: Feb. 16, 2010

(54) SUCTION PILE INSTALLATION METHOD AND SUCTION PILE FOR USE IN SAID METHOD

(75) Inventor: Samy Alhayari, Saint André (FR)

(73) Assignee: Single Buoy Moorings Inc., Marly (CH)

( * ) Notice: Subject to any disclaimer, the term of this patent is extended or adjusted under 35 U.S.C. 154(b) by 187 days.

(21) Appl. No.: 11/607,012

(22) Filed: Dec. 1, 2006

(65) Prior Publication Data

US 2007/0140796 A1 Jun. 21, 2007

Related U.S. Application Data

(60) Provisional application No. 60/741,087, filed on Dec. 1, 2005.

(51) Int. Cl.
*E02D 15/08* (2006.01)
*E02D 5/22* (2006.01)
*B63B 21/27* (2006.01)

(52) U.S. Cl. ..... 405/224.1; 114/296; 114/311

(58) Field of Classification Search ..... 114/295, 114/296, 311; 405/224.1
See application file for complete search history.

(56) References Cited

U.S. PATENT DOCUMENTS 2,466,692 A * 4/1949 Farrell ..... 114/311
3,344,612 A * 10/1967 Rininger ..... 405/226
3,817,040 A * 6/1974 Stevens ..... 405/228
4,036,161 A * 7/1977 Nixon ..... 114/296
4,086,866 A * 5/1978 Nixon ..... 114/295
4,095,550 A * 6/1978 Kerr ..... 114/295
4,270,480 A * 6/1981 Hancock et al. ..... 114/296
4,432,671 A * 2/1984 Westra et al. ..... 405/226
4,576,521 A * 3/1986 Conrad ..... 405/225
4,830,541 A * 5/1989 Shatto ..... 405/226
5,915,326 A * 6/1999 Karal ..... 114/294
6,488,446 B1 * 12/2002 Riemers ..... 405/203
6,685,396 B1 2/2004 Bergeron
6,719,496 B1 4/2004 Von Eberstein

FOREIGN PATENT DOCUMENTS

DE 1940 392 2/1971
WO 99/51821 10/1999

* cited by examiner

*Primary Examiner*—Tara Mayo-Pinnock
(74) *Attorney, Agent, or Firm*—Young & Thomspon

(57) ABSTRACT

Suction pile installation method comprising the steps of lowering a suction pile to the sea bed, while keeping a top end substantially closed providing openings in the suction pile near a lower end, the interior of the suction pile being in open fluid communication with the exterior via the openings, dropping the pile onto the sea bed, while allowing air to escape from the pile via said openings, and allowing the suction pile to penetrate into the sea bed driven substantially by its weight over such a distance that the openings become closed from the exterior, and pumping air from the suction pile for driving the pile further into the sea bed.

10 Claims, 3 Drawing Sheets

SUCTION PILE INSTALLATION METHOD AND SUCTION PILE FOR USE IN SAID METHOD

FIELD OF THE INVENTION

The invention relates to a suction pile installation method and to a suction pile for use in said method.

BACKGROUND OF THE INVENTION

A suction pile is a thin walled steel cylinder, closed at least one longitudinal end, which is placed on the sea bed with a lower end and which penetrates the sub sea soil with the aid of suction (under-pressure) created within the cylinder. The creation of the suction can be with the aid of a suction source, such as a pump, that is mounted on, close to or at a distance (e.g. above the water surface, e.g. at a vessel) from the suction pile. The applied level of the suction can be e.g. at least substantially constant, smoothly increase or decrease or comprise a number of pulses. After use, the suction pile can be removed by creating an overpressure within the cylinder, e.g. by pumping in (sea) water.

Suction piles and their way of installing are known from e.g. U.S. Pat. No. 4,318,641 in the name of Shell. The above patent describes a method and apparatus for securing a tubular element to the bottom of the sea. It describes the steps of lowering the tubular element from the water surface to the water bottom, removably securing the pumping unit to the tubular element either before or after the lowering of the tubular element, closing the tubular element at the upper end, reducing the pressure within the tubular element by operating the pumping unit, so as to cause the tubular element to penetrate into the water bottom to a desired depth. Subsequently, the operation of the pumping unit is stopped and the pumping unit is disconnected from the tubular element and raised to the water surface to recover it.

U.S. Pat. No. 6,719,496 in the name of Shell describes a method for deploying a suction pile anchor in which the flood valves are opened on the top of the suction pile and the suction pile anchor is off loaded from the anchor boat and lowered it to the sea floor. A remote operated vehicle (ROV) with pump capacity is used to close the flood valves and to control the suction into the soil.

The known suction piles and installation methods employ valves on the top of the suction pile in order to accommodate the lowering of the suction pile during landing. The water pressure inside the pile rapidly increases while the pile is landing on the seabed when it is dropped (launched) from several meters above the seabed to penetrate into the soil. The open valves or vents on the top of the pile allow the trapped water to escape and therefore avoid building up a water pressure inside the pile so that large pressure differentials between the inside and outside of the pile are avoided. When the water cannot escape fast enough there will be a pressure build up that will cause a bearing capacity failure in the soil when the pile lands.

After the pile is landed, the vents need to be completely sealed in order to control the internal pressure. If the vents don't completely seal, it is not possible to depressurize the pile to let it penetrate the soil, or to over pressurise it to come back out of the soil. It is needed that each vent ensures a 100% sealing over the lifetime of an installed pile. Therefore the pile cover at the top end should be fitted with specific installation aids. This makes the operation expensive as known pile covers normally have 2 or more valves or costly closing devices which requiring ROV assistance operations, particularly in deep waters.

Normally a submerged pumping skid is attached to the vents and activated by a ROV. The pumping skid is removed after the pile is depressurized. This operation also needs expensive anchor handling tug boats which are provided with a heave compensation system to safely and smoothly land the piles on the seabed.

SUMMARY OF THE INVENTION

It therefore is an object of the present invention to provide for a suction pile installation method and for a suction pile which is of a relatively simple construction and which avoids the use of complex venting valves at the top end.

It is furthermore an object of the present invention to provide a suction pile installation method which can be carried out using a simple installation vessel.

It is again an object of the present invention to provide a suction pile wherein venting can be effectively controlled in a relatively simple and economic manner.

Hereto the installation method according to the invention is characterized by:

- allowing fluid to escape from the pile via at least one opening in the side surface, and
- allowing the suction pile to penetrate into the sea bed over such a distance that the at least one opening in the side surface becomes closed off from the exterior by the soil, and
- pumping air from the suction pile for driving the pile further into the sea bed.

The suction pile has in its lower half, for instance in the first 2-4 meters from the tip of the pile, an opening, such as two or more rows of holes. These holes or other shaped openings will allow the water inside the pile to escape during the first stage of the landing when the suction piles touch down on the seabed.

During this stage no additional internal pressure will be build up inside the pile. In this way it is possible to reach (if required) a controlled pile landing rate, for instance as high as 1 m/s.

As the opening, such as the row of holes in the side surface is in the lower segment of the pile, the first 2 to 3 m of seabed soil, which is anyway muddy, will be washed away by the water escaping from the holes while landing the pile. This disruption of the first mud line will have no significant influence on the pile holding capacity of the soil. As the falling pile penetrates the mud line by its own weight, the pile will penetrate also the soil under the mud line which soil will then cover the holes. After this free fall penetration of the pile into the soil, the pile can be moved further into the soil with the known process of adding an under-pressure within the pile by disconnectable vacuum pumps at the top of the pile activated by a ROV or via a suction hose which is attached to the top of the pile.

The openings in the suction pile can replace the vents on the pile cover except for a small valve, which is used for the suction process (while creating an under pressure for pile penetration or an overpressure for the breakout, if needed). Therefore there no longer is a need for providing complicated and costly closing devices that are operated with a ROV manipulation system.

The pile according to the present invention with one or more openings in the lower side surface section can be easily installed with a known anchor handling tug boat which does not need to be equipped with a heave compensation system or a constant tension devise which normally is required when a control line connects the venting valves on the pile with the vessel. This latter is especially relevant for deep water projects were the suction piles and hence the heave compensation devices need to be relatively large and expensive to be able to reach to the seabed.

The at least one opening in the side surface of the suction pile according to the present invention has furthermore been found to ensure a controlled vertical landing without a large inclination of the pile which ensures an optimal bearing capacity in the soil.

BRIEF DESCRIPTION OF THE DRAWINGS

An embodiment of a suction pile in accordance with the present invention will be explained in detail with reference to the accompanying drawings. In the drawings.

DETAILED DESCRIPTION OF THE EMBODIMENTS

Figure 1:
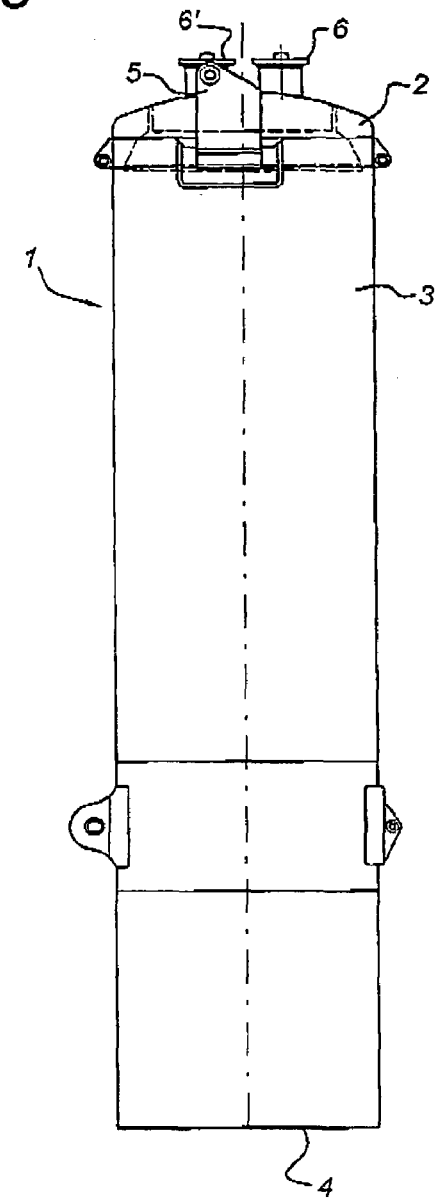
FIG. 1 shows a side view and a top view respectively of a suction pile known from the prior art.
Figure 1A:
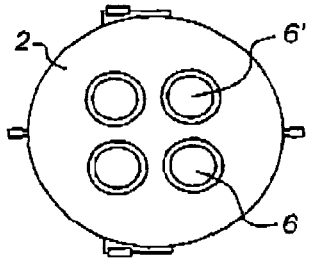
PRIOR ART Fig 1a

FIG. 1 shows a suction pile 1 with a top surface 2, a cylindrical side surface 3, and an open bottom surface 4. The top surface comprises four venting valves 6,6' and an attachment eye 5 for attaching to an anchor cable and/or to a lowering cable upon installation. Upon penetration of the bottom surface 4 into the sea bed, water is vented via the valves 6,6'. Upon creating an under pressure inside the suction pile, for introduction into the sea bed, the valves 6,6' are closed. A pump or air hose is during creation of an under pressure, connected via one of the valves 6,6'.

Figure 2:
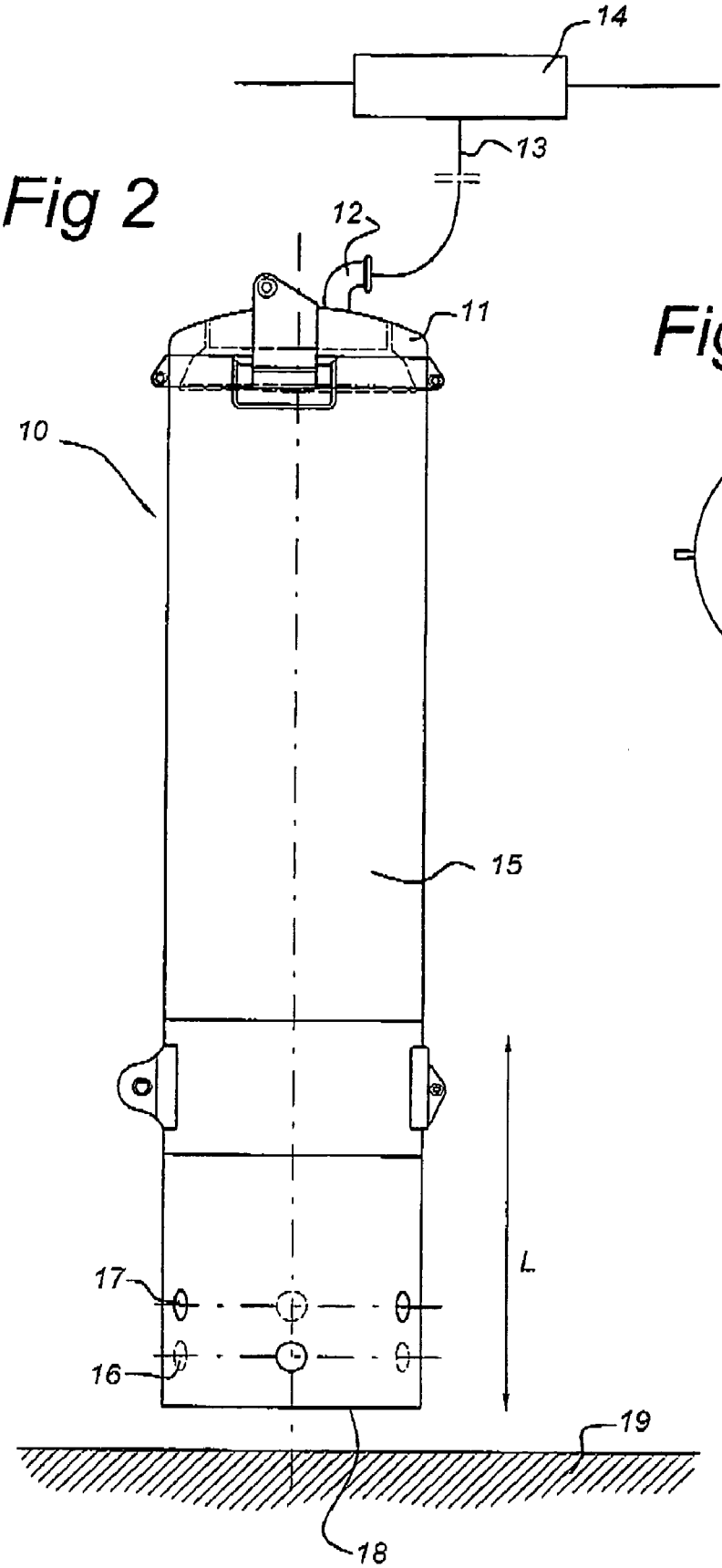
FIG. 2 shows a side view and a top view respectively of a suction pile according to the present invention.
Figure 2A:
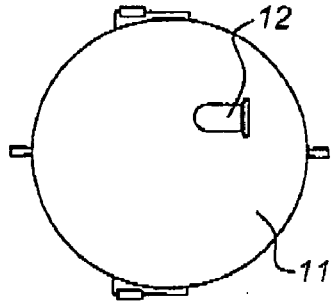
Figure 3:
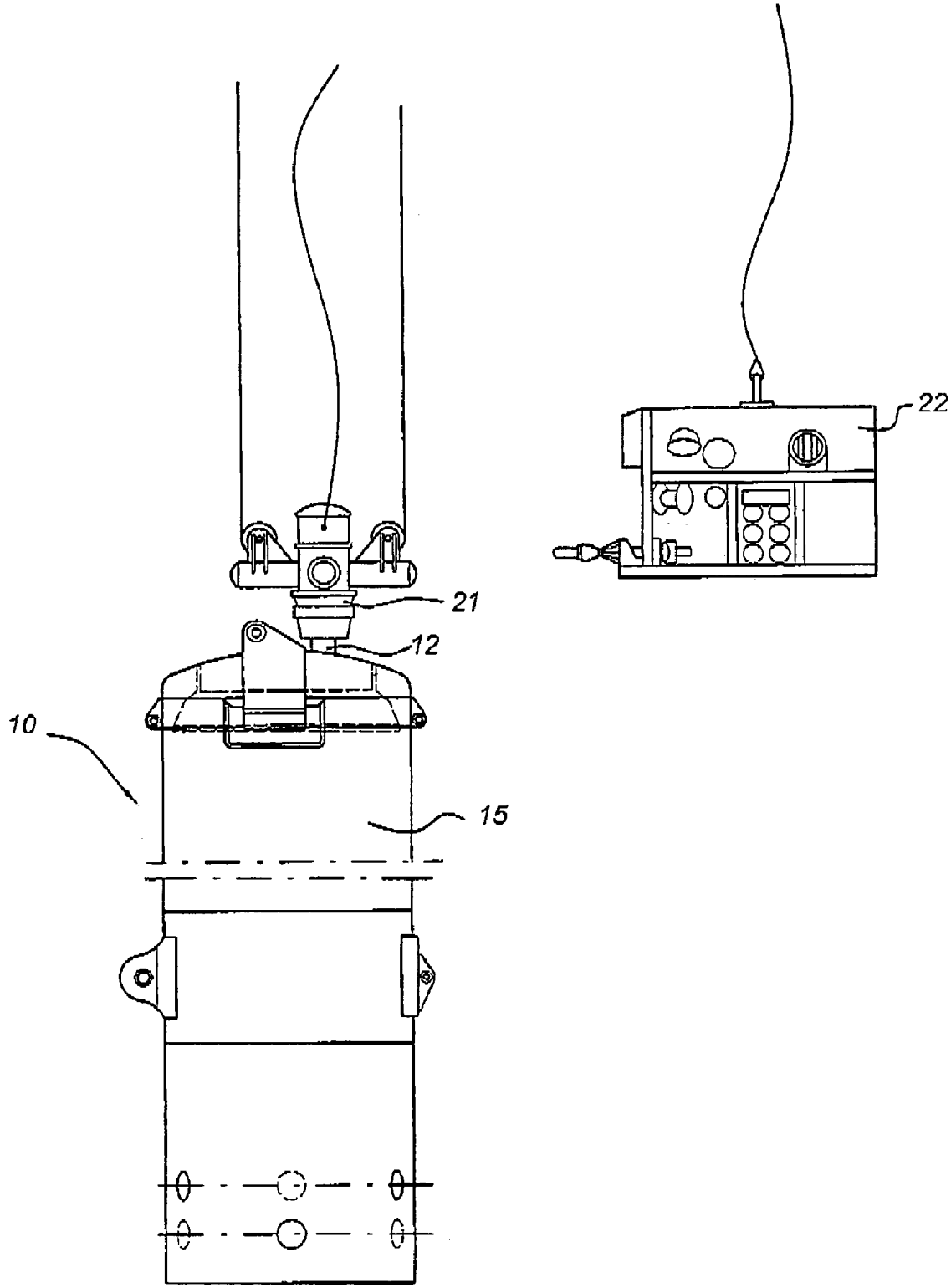
FIG. 3 shows a side view of a suction pile attached to a removable ROV-operated pump skid.

In FIG. 2 it can be seen that in the suction pile 10 according to the invention, only a single air connection, or valve or vent 12 is made in the top surface 11. As can be seen in FIG. 3, the valve 12 can be connected to a removable suction pump skid 21 which is activated by a ROV 22. Alternatively the vent or valve 12 can be directly connected to a surface vessel 14. In the lower halve L of the side surface 15, two rows of openings 16, 17 is present, which provide a venting path via which water can leave the pile 10 when the bottom surface 18 enters into the soil of the sea bed 19. After the holes 16,17 have been closed off by the soil, an under pressure is created inside the pile 10 via the air hose 13, such that the pile is inserted into the soil substantially over its whole length for anchoring a floating structure to the sea bed.

The invention claimed is:

1. A suction pile installation method comprising the steps of:

lowering a suction pile (10) to the sea bed, the suction pile having a top surface (11), a substantially cylindrical side surface (15) and a bottom surface (18) which is at least partially open, keeping the interior of the suction pile in open fluid communication with the exterior at least via the bottom surface, dropping the pile onto the sea bed (19), characterized in that the method comprises:

allowing fluid to escape from the pile via at least one opening (16, 17) in a lower half of the side surface (15) for reducing the pressure inside the suction pile upon contact of the suction pile with the sea bed, and allowing the suction pile to penetrate into the sea bed over such a distance that the at least one opening (16, 17) in the side surface becomes closed off from the exterior by the soil, and pumping air from the suction pile from an air connection (12) situated in an upper half of the suction pile for driving the pile further into the sea bed.

2. The method according to claim 1, wherein the pile (10) is driven into the soil over the distance that the at least one opening (16, 17) becomes blocked substantially by its own weight.

3. The method according to claim 2, wherein the pile (10) is connected to a removable disconnectable pump skid which is activated by a ROV.

4. The method according to claim 2, wherein the pile (10) is connected via an air hose (13) to a surface vessel (14).

5. The method according to claim 1, wherein the pile (10) is connected to a removable disconnectable pump skid which is activated by a ROV.

6. The method according to claim 5, wherein the pile (10) is connected via an air hose (13) to a surface vessel (14).

7. The method according to claim 1, wherein the pile (10) is connected via an air hose (13) to a surface vessel (14).

8. The method according to claim 1, wherein the suction pile (10) is applied from a surface vessel (14) and is attached to said vessel via an elongate member (13) without the use of a tension compensation device.

9. A suction pile (10) comprising:

a top surface (11), a substantially cylindrical side surface (15), a bottom surface (18) which is at least partially open, and an air connection (12) situated in an upper half of the suction pile, the suction pile comprises in a lower half (L) of the side surface at least one opening (16, 17) that allows fluid to escape from the pile to reduce pressure inside the suction pile upon contact of the suction pile with the sea bed.

10. A suction pile (10) according to claim 9, the suction pile comprising in an upper halve a valve (12) for a relatively slow rate of fluid transfer, no fluid venting means being present in the upper halve for fluid transfer from the pile upon entering the soil.

* * * * *